United States Patent [19]

Shore

[11] Patent Number: 4,607,511

[45] Date of Patent: Aug. 26, 1986

[54] TENSION PREFINISHING WITH SIZING STANDS

[75] Inventor: Terence M. Shore, Northwich, England

[73] Assignee: Morgan Construction Company, Worcester, Mass.

[21] Appl. No.: 727,676

[22] Filed: Apr. 26, 1985

[51] Int. Cl.[4] ..... B21B 37/02

[52] U.S. Cl. ..... 72/16; 72/12; 72/234

[58] Field of Search ..... 72/9, 11, 12, 16, 205, 72/234

[56] References Cited

U.S. PATENT DOCUMENTS 4,444,038 4/1984 Ginzburg ..... 72/234

FOREIGN PATENT DOCUMENTS 92219 7/1980 Japan ..... 72/205
126302 9/1980 Japan ..... 72/16
122104 7/1983 Japan ..... 72/16
1575571 9/1980 United Kingdom ..... 72/11

*Primary Examiner*—Francis S. Husar
*Assistant Examiner*—Jorji M. Griffin
*Attorney, Agent, or Firm*—Thompson, Birch, Gauthier & Samuels

[57] ABSTRACT

A method and apparatus for controlling the gauge of a product, such as for example a rod or bar, as the product is passing from an upstream roll stand to a finishing block. The product is rolled under tension between successive sizing stands arranged between the upstream roll stand and the finishing block. Variable loops are introduced in the product between the upstream stand and the first sizing stand as well as between the second sizing stand and the finishing block. Cross sectional dimensional measurements are taken of the product emerging from the second sizing stand, and signals representative of such measurements are employed by a controller to vary the product tension between the sizing stands in order to correct off gauge conditions in the product emerging from the second sizing stand.

7 Claims, 2 Drawing Figures

TENSION PREFINISHING WITH SIZING STANDS

BACKGROUND OF THE INVENTION

This invention relates generally to the hot rolling of rod and bar products, and is concerned in particular with the high speed rolling of close tolerance ferrous rod.

Over the last several decades, significant increases have been realized in the speeds at which ferrous rods are produced. For example, the mill delivery speed for 5.5 mm. rod has risen from about 40 m./sec. in the early 1960's to current speeds of 100 m./sec. Still higher speeds are now being proposed for future mills.

The credit for this advance is due in large part to the development of high speed finishing blocks of the type described in U.S. Pat. No. RE 28,107 (Wilson et al). These blocks employ small diameter cantilevered work rolls. The successive work roll pairs are mechanically tied to and driven by a common power source, and their axes are staggered by 90° to provide twist-free rolling. The product is kept under very slight tension as it accelerates through the block.

The roll pairs are symmetrically adjustable to thereby provide a means of controlling the tolerance of the finished product. Such adjustments are usually required to compensate for variations in the temperature and tolerance of the product being fed to the finishing block. However, as finishing speeds continue to increase, it becomes more and more difficult to make needed roll parting adjustments in a timely manner and without upsetting the delicate tension relationship between successive roll passes in the finishing block.

The objective of the present invention is to provide a means of exercising much closer control over the tolerance of the product being fed to the finishing block, thereby making it possible to significantly reduce and perhaps largely eliminate the need for making roll parting adjustments in the finishing block.

SUMMARY OF THE PRESENT INVENTION

The present invention entails rolling the product under modest tension between successive first and second sizing stands arranged between the last stand of the intermediate mill (hereafter referred to as the "upstream stand") and the finishing block. As herein employed, the term "sizing stand" defines a roll stand wherein a light reduction of less than than about 5% is taken on the product.

Variable loops are introduced in the product between the upstream stand and the first sizing stand, and between the second sizing stand and the finishing block. Dimensional measurements are taken of the product emerging from the second sizing stand. When such measurements indicate an off gauge condition, adjustments are made to the rolling speed of at least one of the sizing stands to vary the tension of the product passing therebetween to an extent sufficient to correct the off gauge condition.

Under ideal operating conditions, the product produced by the upstream stand will be just slightly larger than that intended to be fed to the finishing block. The first sizing stand will impart an ovality to the product as it takes its modest reduction, and this ovality will be corrected by the second sizing stand as it takes its modest reduction, with the result being that a perfect round of the desired size is fed to the finishing block. The speed relationship between the two sizing stands will remain steady as long as this ideal condition persists. However, should the upstream stand begin to produce an oversize product, the product emerging from the second sizing stand also will be oversize. As soon as this condition is noted, the operating speed of the first sizing stand is decreased, thereby increasing the tension in the product passing between the two sizing stands. This increase in tension reduces the cross section of the product sufficiently to correct the oversize condition. Similarly, if the upstream stand begins to roll an undersize product, the operating speed of the second sizing stand is increased to lower interstand tension and thereby increase the product cross section.

A switch and shear combination is advantageously located between the second sizing stand and the looping mechanism preceding the finishing block. The switch and shear combination operates to prevent off gauge product from reaching the finishing block.

Advantageously, dimensional measurements also are taken as the product emerges from the upstream stand, and these are used to anticipate the arrival of the product at the sizing stands, thereby reducing the time required to make any needed corrective adjustments to their operating speeds.

DESCRIPTION OF PREFERRED EMBODIMENT

Figure 1:
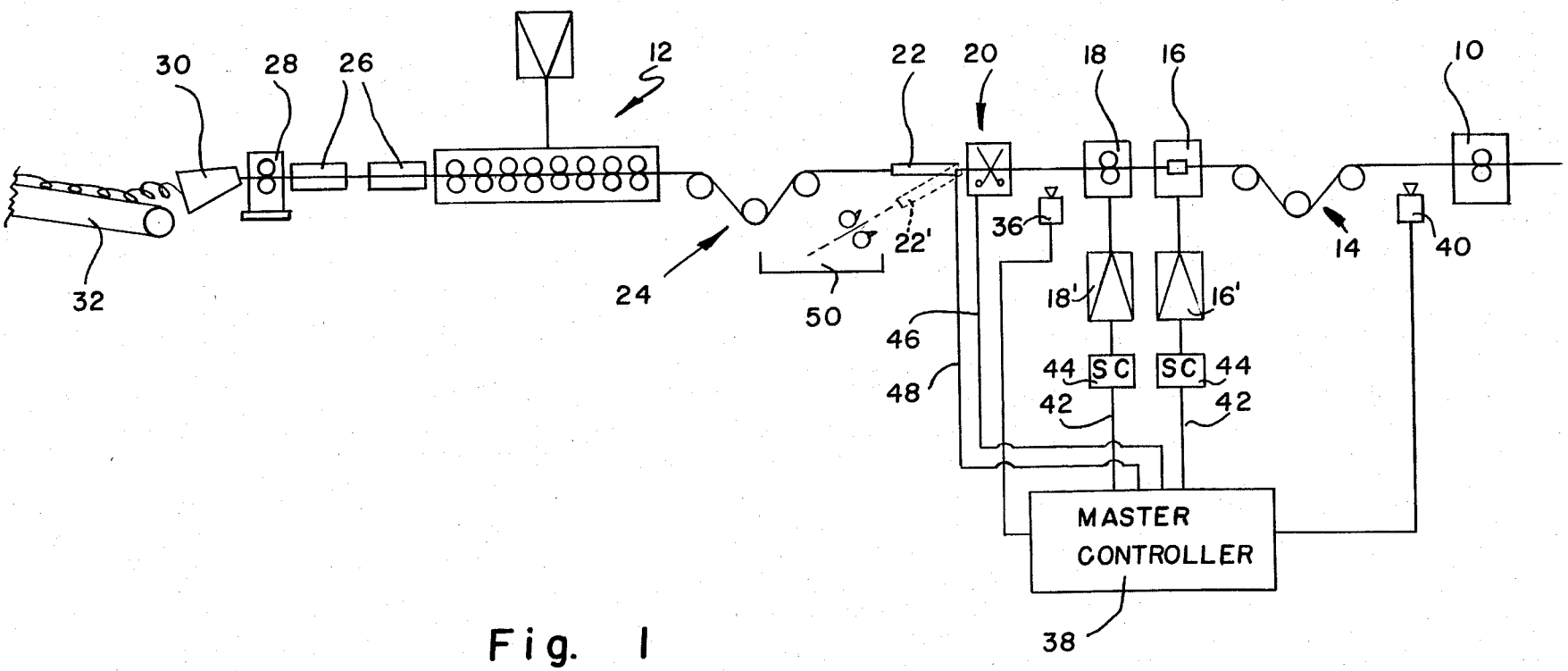
FIG. 1 is a partial diagramatic illustration of a mill installation in accordance with the present invention.

Referring initially to FIG. 1, an upstream stand (the last roll stand of the intermediate train) is shown at 10. Under ideal conditions, the process section emerging from stand 10 will be a perfect round, and of a size just slightly larger than that intended to be fed to the downstream finishing block 12. The process section will be directed from stand 10 through a looping device 14 and then through first and second sizing stands 16,18, each being driven respectively by its own variable speed drive motor 16',18'. As previously mentioned, both sizing stands 16, 18 will effect modest reductions of less than about 5%. In so doing, sizing stand 16 will impart an ovality to the process section, and this ovality will be eliminated by the second sizing stand 18, thereby returning the process section to a perfect round. The drive motors 16', 18' are set to maintain the process section passing between the sizing stands under tension, and this tension in combination with the reductions effected by the sizing stands is sufficient to produce the size intended to be fed to the finishing block 12.

Upon emerging from the second sizing stand 18, the process section then continues successively through the operative range of a shear 20, a switch 22 and a looping device 24 before entering the finishing block.

The finishing block produces the finished rod, which then may be processed further through water boxes 26, a set of pinch rolls 28 and a laying head 30 which deposits the rod in ring form on a cooling conveyor 32. After cooling, the rings are collected into coils by a reforming tub (not shown).

Figure 2:
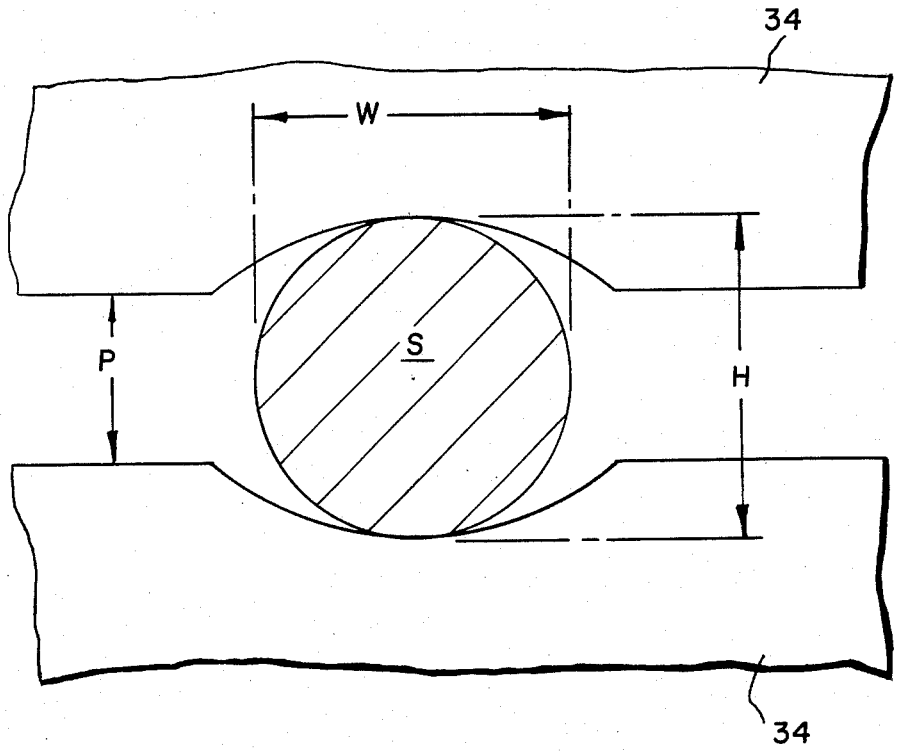
FIG. 2 is a cross sectional view on an enlarged scale taken through the roll pass of the second sizing stand.

With reference to FIG. 2, it will be understood that under ideal conditions, the process section "S" produced by the work rolls 34 of the second sizing stand 18 will be a perfectly sized round, with identical height and width measurements "h" and "w". These measurements are monitored by a gauge 36 positioned immediately downstream from the second sizing stand, and signals representative of such measurements are directed to a master controller 38. Preferably, the height and width dimensions of the process section emerging from the upstream stand 10 are measured by a second gauge 40, and its representative signals also are directed to the master controller 38. The gauges 36, 40 may be of known design, such as for example the Model 120 Laser Telemetric System supplied by Zygo Corporation of Middlefield, Conn., U.S.A. The master controller is connected via control lines 42 and speed controllers 44 to the drive motors 16',18' of the sizing stands 16,18, in addition to being connected via control lines 46,48 to the shear 20 and switch 22.

With reference again to FIG. 2, it will be understood that because the rolls 34 wear very slowly due to the light reduction being taken, the roll parting "P" can remain substantially constant, which in turn means that the height h of the exiting process section S will also be substantially constant. Thus, an oversize off-gauge condition will result in an overfilling of the roll pass reflected by an increase in the product width w. By the same token, an undersize off-gauge condition will result in an underfiling of the roll pass reflected by a decrease in product width w.

When the gauge 36 senses an oversize off-gauge front end, the main controller 38 reacts by operating switch 22 to the position indicated by broken lines at 22', thereby deflecting the front end to a chopping shear 50 which cuts the off-gauge product into scrap sections. At the same time, the main controller operates through one or both of the speed controllers 44 to increase the tension between the sizing stands 16 and 18 by adjusting the operating speeds of one or both of the drive motors 16', 18'. This increase in tension between the two sizing stands reduces the cross sectional area of the process section entering the second sizing stand 18, thereby reducing the width w of the process section exiting therefrom. Any speed variations of the sizing stands 16, 18 is compensated for by the looping mechanisms 14 and 24. When the gauge 36 senses that the oversize off gauge condition has been corrected, the main controller triggers shear 20 and operates switch 22 to redirect the product through the downstream looping mechanism 24 for entry into the finishing block 12.

A similar procedure is followed when the gauge 36 senses an undersize off-gauge condition, except that under these circumstances, the controller 38 operates to decrease the product tension between the two sizing stands 16,18.

If any off-gauge condition is sensed at an intermediate location in a billet length of material, or at the tail end, then the shear 20 must be operated prior to operating the switch 22 in order to direct the product to the chopping shear 50.

The second gauge 40 advantageously provides advance warning of off-gauge conditions at the exit side of the upstream stand 10, thereby allowing the main controller 38 to anticipate such conditions and to react more quickly with appropriate adjustments to the drive motors 16'.18' and timely operation of the shear 20 and switch 22.

In light of the foregoing, it will now be seen that with the present invention, continuous control is exercised over the gauge of the product exiting from the upstream stand 10, with off-gauge sections being eliminated before they reach the finishing block 12. This in turn enables rolling conditions in the finishing block to remain essentially stable, thereby producing a high tolerance finished rod.

I claim:

1. A method of controlling the gauge of a product, such as for example a rod or bar, as the product is passing from an upstream roll stand to a finishing block, said method comprising: rolling the product under tension between successive first and second sizing stands arranged between said upstream roll stand and said finishing block; introducing variable loops in the product between said upstream roll stand and said first sizing stand, and between said second sizing stand and said finishing block; taking cross sectional dimensional measurements of the product emerging from said second sizing stand; and when said measurements indicate an off gauge condition in the product emerging from said second sizing stand, adjusting the rolling speeds of at least one of said sizing stands in order to correct the off gauge condition by varying the tension in the product passing therebetween.

2. The method of claim 1 further comprising the step of shearing and removing off gauge product emerging from said second sizing stand.

3. The method of claims 1 or 2 wherein the product exits from said second sizing stand with a substantially constant height, and wherein said measurements reflect changes in the width of said product.

4. The method of claims 1 or 2 further comprising the taking of additional cross sectional dimensional measurements of the product emerging from said upstream stand, and when said additional measurements indicate an off gauge condition, adjusting the rolling speeds of at least one of said sizing stands in order to correct said off gauge condition by varying the tension in the product passing therebetween.

5. Apparatus for controlling the gauge of a product, such as for example rod or bar, as the product is passing from an upstream stand to a finishing block, said apparatus comprising:

first and second sizing stands successively arranged between said upstream stand and said finishing block;

means located between said upstream stand and said first sizing stand and between said second sizing stand and said finishing block for introducing variable loops in the product;

gauge means located downstream of said second sizing stand for taking cross sectional dimensional measurements of the product emerging from said second sizing stand and for generating signals representative of such measurements; and control means connected to the drives of said sizing stands for controlling the operational speed of said sizing stands to maintain the product passing therebetween in tension, and to vary the level of said tension in response to signals from said gauge means which are indicative of off gauge conditions in the product emerging from said second sizing stand.

6. The apparatus of claim 5 further comprising means downstream of said second sizing stand for shearing and removing off gauge product emerging fronm said second sizing stand, thereby preventing said off-gauge product from being fed to said finishing block.

7. The apparatus of either claims 5 or 6 further comprising additional gauge means located between said upstream stand and said sizing stands for taking cross sectional dimensional measurement of the product and for generating signals representative of such measurements for use by said control means to anticipate expected rolling conditions at said sizing stands.

* * * * *

UNITED STATES PATENT AND TRADEMARK OFFICE

CERTIFICATE OF CORRECTION

PATENT NO. : 4,607,511

DATED : August 26, 1986

INVENTOR(S) : Terence M. Shore

It is certified that error appears in the above—identified patent and that said Letters Patent is hereby corrected as shown below:

Col. 2, line 12, change "increased" to --decreased--.

Signed and Sealed this

Tenth Day of March, 1987

*Attest:*

DONALD J. QUIGG

*Attesting Officer*

*Commissioner of Patents and Trademarks*